US006422391B1

(12) United States Patent
Swartz

(10) Patent No.: US 6,422,391 B1
(45) Date of Patent: Jul. 23, 2002

(54) CHILD-RESISTANT MEDICAMENT PACKAGE AND METHOD OF OPENING

(75) Inventor: Todd C. Swartz, Kentwood, MI (US)

(73) Assignee: L. Perrigo Company, Allegan, MI (US)

( * ) Notice: Subject to any disclaimer, the term of this patent is extended or adjusted under 35 U.S.C. 154(b) by 0 days.

(21) Appl. No.: 09/557,529

(22) Filed: Apr. 24, 2000

Related U.S. Application Data

(60) Provisional application No. 60/172,718, filed on Dec. 20, 1999.

(51) Int. Cl.[7] ..... B65D 83/04
(52) U.S. Cl. ..... 206/531; 206/532; 206/469
(58) Field of Search ..... 206/531, 534, 206/532, 467, 468, 469

(56) References Cited

U.S. PATENT DOCUMENTS 3,780,856 A * 12/1973 Braverman ..... 206/531
3,835,995 A * 9/1974 Haines ..... 206/531
3,921,805 A * 11/1975 Compere ..... 206/531
4,398,635 A 8/1983 Hirt
5,088,603 A * 2/1992 Kirkpatrick ..... 206/530
5,551,567 A * 9/1996 Malone et al. ..... 206/469
6,036,016 A * 3/2000 Arnold ..... 206/532
6,085,942 A * 7/2000 Redmond ..... 222/107

* cited by examiner

*Primary Examiner*—Mickey Yu
*Assistant Examiner*—Jila M. Mohandesi
(74) *Attorney, Agent, or Firm*—Price, Heneveld, Cooper, DeWitt & Litton

(57) ABSTRACT

A blister pack includes a die cut tab intermediate one edge of the blister pack and the medicament contained therein such that the tab is removed by tearing away from the medicament to define two spaced-apart legs which subsequently provide readily accessible gripping legs for subsequently tearing apart and opening the blister pack for accessing the medicament contained therein. In a preferred embodiment, the die cut tab is a generally V-shaped notch formed with the apex of the notch directed toward the medicament and which can be deflected from the plane of the blister pack and removed to define the spaced-apart legs subsequently employed for the opening of the blister pack.

13 Claims, 2 Drawing Sheets

CHILD-RESISTANT MEDICAMENT PACKAGE AND METHOD OF OPENING

CROSS-REFERENCE TO RELATED APPLICATION

This application claims priority under 35 U.S.C. § 119(e) on U.S. Provisional Application No. 60/172,718 entitled CHILD-RESISTANT MEDICAMENT PACKAGE METHOD OF OPENING, filed on Dec. 20, 1999, the entire disclosure of which is incorporated herein by reference.

BACKGROUND OF THE INVENTION

The present invention relates to a child-resistant medicament package and particularly to an opening feature for a blister-type package.

Blister packages have become very popular for the child-resistant packaging of medicaments, such as antihistamines and other medicaments which are available over the counter and in common use by adults but which must be taken according to instructions and are required to be packaged in a child-resistant package. In the past, a package has been provided with a paper foil backing over which a polymeric film is heat-sealed to encase the medicament in what is generally referred to as a blister pack.

In order to access the medicament for use, a die cut is typically formed in spaced relationship with an edge of the package and aligned with the blister enclosing the medicament.

The die cut slit allows an adult to tear open the blister pack with some effort by tearing through the edge material and then the blister for gaining access to the medicament. Typically, a child will not have the strength required to open such a package.

Although such packages have provided an effective and very popular child-resistant package for medicaments, they are very difficult to open even for an adult. Accordingly, there remains a need for a blister-type medicament package and one which is child-resistant but one which also allows for easier opening capabilities available primarily to an adult with the cognitive ability to utilize the opening mechanism.

SUMMARY OF THE INVENTION

The blister pack of the present invention provides this advantage by incorporating a die cut tab intermediate one edge of a blister pack and the medicament contained therein such that the tab is removed tearing away from the medicament to define two spaced-apart legs which subsequently provide readily accessible gripping legs for subsequently tearing apart and opening the blister pack for accessing the medicament contained therein. In a preferred embodiment of the invention, the die cut tab is a generally V-shaped notch formed with the apex of the notch directed toward the medicament and which can be deflected from the plane of the blister pack and removed to define the spaced-apart legs subsequently employed for the opening of the blister pack. The legs are torn apart typically by tearing in a direction opposite the plane of the blister pack for severing the film blister over the area of the medicament for gaining access to the medicament.

With such a package, an adult has the cognitive ability to understand that it is necessary to remove the tab in a direction opposite the medicament to provide the legs which, once defined by the removal of the tab and the material extending between the tab and the edge, are easily grasped to facilitate the opening of the blister pack.

These and other features, objects and advantages of the present invention will become apparent upon reading the following description thereof together with reference to the accompanying drawings.

DETAILED DESCRIPTION OF THE PREFERRED EMBODIMENT

Figure 1:
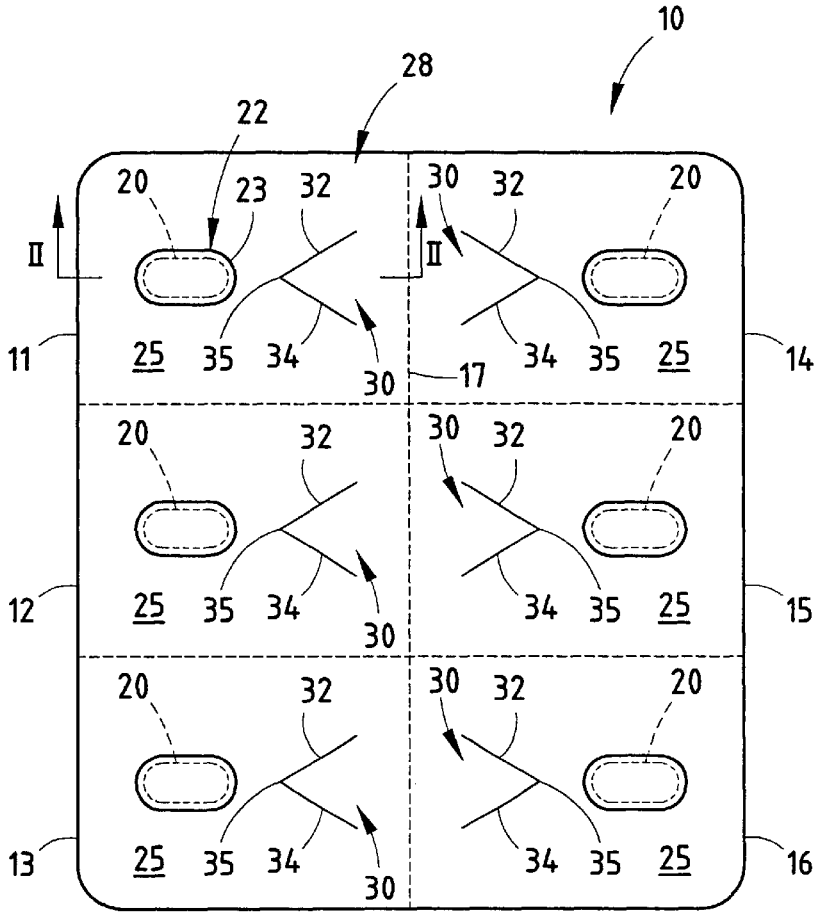
FIG. 1 is a plan view of a blister pack embodying the present invention.

Referring initially to FIG. 1, there is shown a top plan view of a blister pack 10 embodying the present invention and which includes six sections 11 through 16. Each of the sections 11–16 are separated by serrated edges such that an individual section containing a medicament dosage may be removed from the overall package. Each section includes a medicament 20 contained therein which can be any type of over the counter medication commonly available for adults but which may include, for example, antihistamines or other active ingredients which must be carefully administered and, therefore, require child-resistant packaging. The medicament 20 typically may be one or more tablets, gelcaps, geltabs, or liquid-gels or other self-contained dosage forms in common use. The blister pack 10 typically will include an outer transparent polymeric layer 25 made of a film of PVC, PP, PE or PET having a thickness of about 0.003" to 0.015" and which is heat-sealed to a underlying support or substrate layer 26 typically having a foil surface facing film layer 25 and a paper backing as is common in blister packaging. Thus, each medicament dosage is enclosed in a blister 22 formed between the substrate layer 26 and the film layer 25. To gain access to the medicament 20, therefore, it is necessary to tear through the blister 22 so the medicament can be removed from the package.

The blister pack 10 of the present invention provides a triangular-shaped tab 30 for each of the blister pack sections, which tab is defined by a first leg 32 and a second leg 34 die cut through the film 25 and backing layer 26 and having an apex 35 pointed toward the blister 22 of the package. The triangular tab. 30 is formed approximately midway between the edge 17 of the blister pack and the edge. 23 of blister 22, with each leg 32 having a length in the preferred embodiment of approximately from about 3 mm to about 6 mm. The legs 32, 34 defining the triangular tab converge at an angle of approximately from about 20° to about 60°, although the triangular tab can be formed at other angles up to about 90°. The tab likewise need not necessarily be triangular, although it is desired to have an apex 35 of some sort located in alignment with the blister 22 such that when the tab 30 and material around the tab is removed from the package as described below, two spaced-apart legs are defined which allow the tearing open of the blister pack. Also, a sharp point 35 deters children from chewing on a partially open blister pack, such as shown in FIG. 2.

Figure 2:
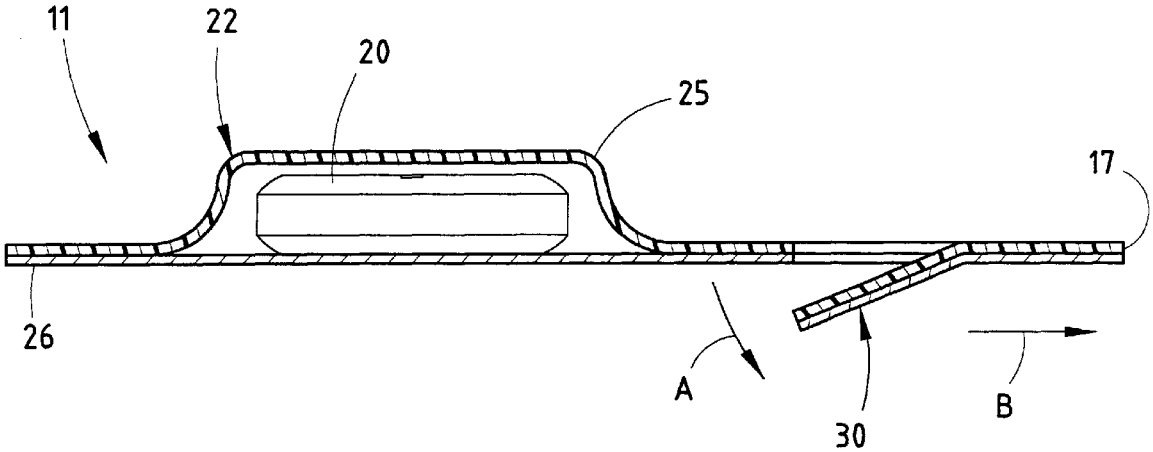
FIG. 2 a cross-sectional view of one section of the blister pack shown in FIG. 1, shown with the, downwardly pressed for access thereto.

As seen in FIG. 2, to open the package and gain access to the medicament 20, the tab 30 is deflected downwardly in a direction indicated by arrow A, such that it extends downwardly from the plane of the package. The tab 30 likewise could be deflected upwardly, if desired, inasmuch as it is only necessary to gain access to the tab for subsequently tearing it from the edge of the blister pack in the direction indicated by arrow B in FIG. 2. The tab should have a size sufficient for an adult to readily easily grip and, once deflected from the plane of the package as shown in FIG. 2, tear the tab and film and backing material in the area 28 between edge 17 of the package and the tab 30 from the package. This defines, as seen in FIG. 3, a pair of legs 40 and 42 for the blister pack 11 illustrated in FIGS. 2–5 with the apex 35 of the now triangular terminated slot 45 between legs 40 and 42 adjacent and directed toward blister 22.

Figure 3:
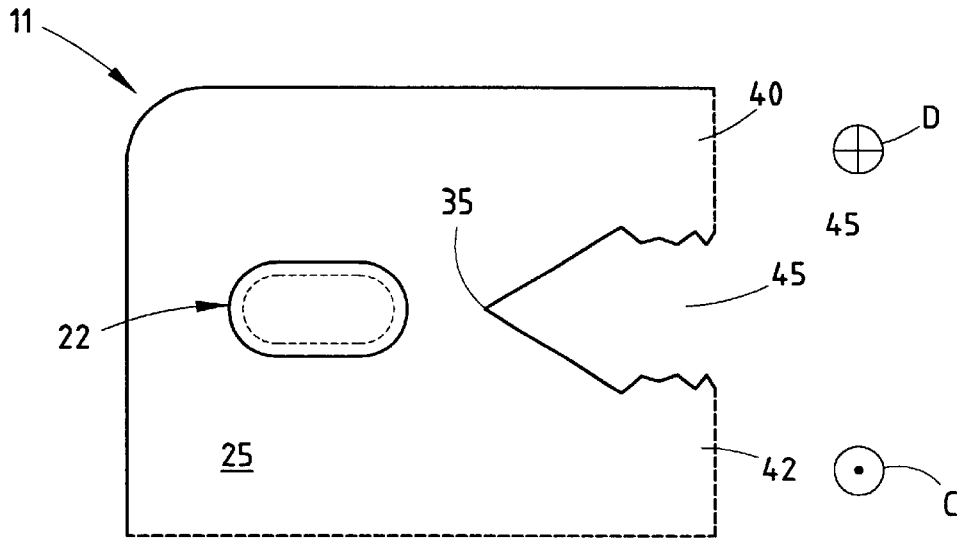
FIG. 3 is a top plan view of the blister pack section shown in FIG. 2, shown with the tab and material between the edge of the tab and the blister pack removed for defining spaced-apart legs.
Figure 4:
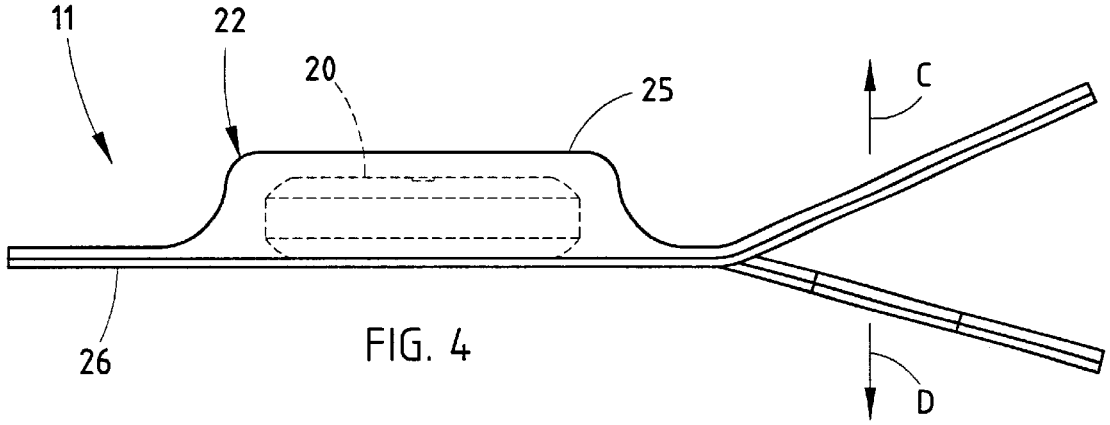
FIG. 4 is a side elevational view of the structure shown in 3, taken along the direction of line IV, showing the movement of the legs to effect opening of the blister pack.
Figure 5:
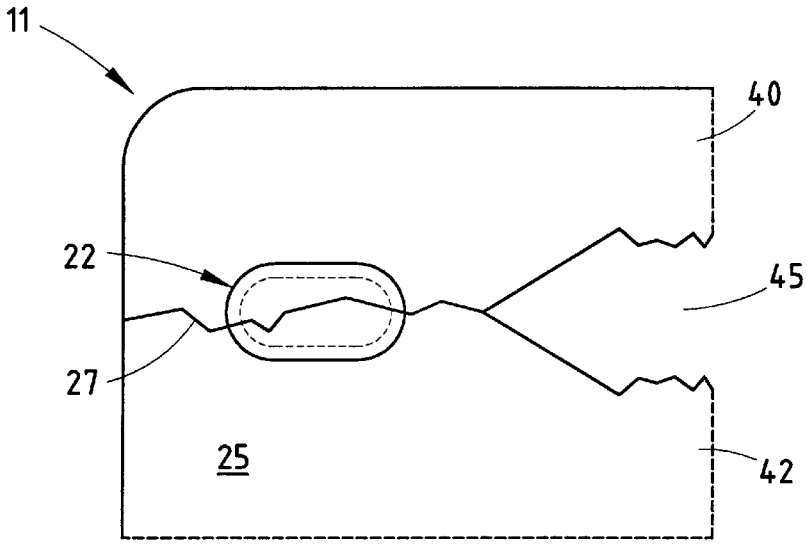
FIG. 5 is a top plan view of the blister pack shown once the blister pack has been opened to gain access to the medicament contained therein.

Legs 40 and 42 are then moved in opposite directions from one another, such as illustrated by arrows C and D in FIGS. 3 and 4, with the legs defining convenient handles for the purpose of fracturing the blister 22, as shown in FIG. 5, for gaining access to the medicament 20 contained therein. The legs 40 and 42 likewise could be moved in a direction parallel to the plane of the package, that is away from each other in a horizontal direction, as seen in FIG. 4, instead of a vertical direction as represented in FIG. 4, although the vertical direction typically will provide a cleaner fracture along a line, for example line 27 shown in FIG. 5, for access to the medicament.

Thus, the system of the present invention operates on the principle of providing a two-step opening process requiring the cognitive ability to access a tear-away tab which is then torn in a direction opposite that of the medicament to remove a section of the blister pack. These steps then define a pair of spaced-apart legs which subsequently can be employed for opening the blister pack. The package cannot be opened by tearing at one of the edges 17. Once the legs 40 and 42 are defined, however, it is easier for an adult to grasp them and subsequently open the blister pack. The force required to strip tab 30 and the surrounding material from the package, such as section 11 of the blister pack 10 of the present invention, is a function of the geometry and location of the notch and ranges from about 2 lbs. to about 6 lbs., as is the subsequent force to open the blister pack. Legs 40 and 42, however, provide convenient handles and the package is, therefore, easier to open once the tab and adjacent material is removed than the prior art of blister packs utilizing a single slit spaced inwardly from an edge of the blister pack.

The length of cuts defining legs 32, 34 for the V-shaped tab 30 will determine how difficult the package is to open. For example, legs that are 3 to 4 mm long are difficult to initiate, thus more child-resistant than cuts that are 5 to 6 mm. The length of the cuts utilized are selected by the amount of openability desired. The convergence angle between the legs 32, 34 will also determine the ease of opening ability. The wider the angle, the easier the opening feature is to initiate. The narrower the angle, the harder or more child-resistant the package. If the angle is 20° to 35°, the package is much harder to open than if the package utilizes a 45° to 60° angle. The distance of the apex 35 from blister 22 determines the difficulty of opening the package. The distance the tab is away form any edge of the package will determine how difficult the package is to tear. The further the tab from the edge of the blister package, the harder the package is to open or the more child-resistant the package. A distance of 4 to 12 mm is best for a child-resistant package.

The tip 35 of the notch also acts as a deterrent in keeping children from chewing on the package. The pointed section is sharp, and the idea behind this is to make the package sharp and, thus aid in keeping children from putting the package in their mouths. The sharpness of this package also can help aid in alerting a parent to a crying child rather than an overdosed one.

It will become apparent to those skilled in the art that various modifications to the child-resistant package of the present invention as described herein can be made without departing from the spirit or scope of the invention as defined by the appended claims.

The invention claimed is:

1. A blister pack for a medicament comprising:

a substrate;

a film layer over said substrate defining a blister containing a medicament between said film and substrate; and a tab formed by a cut edge having a pair of converging legs defining an apex at their intersection and extending through said film and substrate for allowing removal of the tab to define a pair of spaced-apart legs which are subsequently torn apart for opening the blister pack.

2. The blister pack as defined in claim 1 wherein said tab is generally V-shaped.

3. The blister pack as defined in claim 2 wherein the apex is pointed toward the blister.

4. The blister pack as defined in claim 3 wherein said tab is defined by a pair of legs converging at an angle of from about 20° to about 90°.

5. The blister pack as defined in claim 4 wherein each of said legs has a length of from about 3 mm to about 10 mm.

6. The blister pack as defined in claim 5 wherein the apex of said tab is from about 4 mm to about 12 mm from the blister.

7. A method of opening a blister pack for a medicament comprising:

deflecting a tab formed by a cut having a pair of converging legs defining an apex at their intersection and extending through a film and substrate which also defines a blister containing a medicament away from the substrate;

tearing the tab from the substrate in a direction away from the blister to define a pair of spaced-apart legs; and moving the legs in opposite directions to tear the film forming the blister for accessing the medicament.

8. A child-resistant blister pack for a medicament requiring a two-step opening process, said blister pack comprising:

a substrate;

a film layer over said substrate for defining a blister containing a medicament between said film and substrate; and a tab formed by a cut edge having a pair of converging legs defining an apex at their intersection and extending through said film and substrate for allowing removal of the tab from an edge of said blister pack to define a pair of spaced-apart legs which can subsequently be torn away from one another to tear open the blister to gain access to the medicament.

9. The blister pack as defined in claim 8 wherein said tab is generally V-shaped.

10. The blister pack as defined in claim 9 wherein the apex is pointed toward the blister.

11. The blister pack as defined in claim 10 wherein said tab is defined by a pair of legs converging at an angle of from about 20° to about 90°.

12. The blister pack as defined in claim 11 wherein each of said legs has a length of from about 3 mm to about 10 mm.

13. The blister pack as defined in claim 12 wherein the apex of said tab is from about 4 mm to about 12 mm from the blister.

* * * * *